US008113993B2

(12) United States Patent
McVan

(10) Patent No.: US 8,113,993 B2
(45) Date of Patent: Feb. 14, 2012

(54) EXERCISE GRIP FOR EXERCISING PECTORAL MUSCLES

(75) Inventor: Michael McVan, Wellington, FL (US)

(73) Assignee: Perfect Pecs, LLC, Wellington, FL (US)

( * ) Notice: Subject to any disclaimer, the term of this patent is extended or adjusted under 35 U.S.C. 154(b) by 295 days.

(21) Appl. No.: 12/228,803

(22) Filed: Aug. 14, 2008

(65) Prior Publication Data

US 2010/0041524 A1 Feb. 18, 2010

(51) Int. Cl.
*A63B 21/00* (2006.01)

(52) U.S. Cl. ..... 482/49; 482/108; 482/121

(58) Field of Classification Search ..... 38/107; 482/49, 107, 907, 904, 908, 98, 101, 121, 482/109

See application file for complete search history.

(56) References Cited

U.S. PATENT DOCUMENTS

| | | | | | |
|---|---|---|---|---|---|
| D157,725 | S | * | 3/1950 | Foster | D32/70 |
| 3,465,108 | A | * | 9/1969 | Melso et al. | 200/33 A |
| 4,157,827 | A | * | 6/1979 | Winston et al. | 482/82 |
| 4,351,526 | A | * | 9/1982 | Schwartz | 482/108 |
| 4,433,497 | A | * | 2/1984 | Foster et al. | 38/107 |
| 4,684,122 | A | | 8/1987 | Desmond et al. | |
| 4,756,527 | A | | 7/1988 | Ledbetter | |
| 5,423,730 | A | * | 6/1995 | Hirsch | 482/92 |
| 5,533,952 | A | * | 7/1996 | Schaber | 482/70 |
| 5,688,212 | A | | 11/1997 | Walker | |
| 6,340,341 | B1 | | 1/2002 | Purcell | |
| 6,342,033 | B1 | | 1/2002 | Walker | |
| 6,390,959 | B1 | | 5/2002 | Tornabene et al. | |
| 6,558,302 | B2 | * | 5/2003 | Cluff | 482/129 |
| 6,620,082 | B1 | | 9/2003 | Siegel | |
| D484,929 | S | * | 1/2004 | Mollet | D21/662 |
| 6,692,416 | B1 | | 2/2004 | Davis | |

OTHER PUBLICATIONS

Museum of Scotland (http://www.nms.ac.uk/scotland/home/index.asp) Edinburgh Copyright 2005David Monniaux photo file:flat irons dsc05527.jpg.*

* cited by examiner

*Primary Examiner* — Jerome W Donnelly
(74) *Attorney, Agent, or Firm* — Robert M. Downey, P.A.

(57) ABSTRACT

An exercise grip and method for performing a low cable pectoral muscle development exercise is disclosed wherein the exercise grip is attachable to a cable weight system. The exercise grip includes a body substantially formed to receive thereon the palmer side of a human hand. The body has an upturned flange formed at an outer edge of the body to bear against the ulnar border of a human hand. An elongate finger grip extends from and is oriented substantially perpendicular to the upturned flange and is formed to accommodate the curled fingers of a human hand therearound. A thumb recess is adjacent to the finger grip opposite from the upturned flange for allowing a human thumb to bear thereagainst. A hook is affixed to the body proximate to the thumb recess to facilitate attachment to the cable of the cable weight system.

3 Claims, 3 Drawing Sheets

EXERCISE GRIP FOR EXERCISING PECTORAL MUSCLES

BACKGROUND OF THE INVENTION

1. Field of the Invention

The present invention relates to bodybuilding exercises and more particularly to a specialized handle grip and method for exercising pectoral muscles.

2. Discussion of the Related Art

Body strength and a well toned body have long been admired as a personal achievement and one that more and more people strive for worldwide. Presently, Millions of people workout on a daily basis for health reasons, personal satisfaction and appearance, as well as for competition. Bodybuilding as a sport began in the late nineteenth century and continued to gain in popularity into the mid and late nineteenth century. Most people are familiar with bodybuilding as a competitive sport wherein the competitors display their physiques to a panel of judges. The judges then assign points based on their aesthetic appearance to determine the winner of the competition.

Bodybuilding is the process of maximizing muscle hypertrophy through the combination of proper caloric intake, rest and weight training. As the sport evolved and progressed, the goals have become increasing muscle mass while also achieving muscle symmetry and definition. These goals are accomplished through improved training techniques, better nutrition and more effective equipment. Newer innovations in equipment used for the weight training aspect of bodybuilding have facilitated the targeting of specific muscle groups for development, and in many instances individual muscles can be individually targeted for sculpting by specific exercises.

The upper body is a primary target for development by serious bodybuilders and amateurs alike, and the most targeted muscles in the upper body are the muscles of the chest region, namely the pectoral muscles. Many exercises are available to use for development of both the major and minor pectorals and are designed around the use of either free weights or weight machines. Some of these exercises are tailored to work the upper pectorals such as the incline press, and some are tailored to work the lower pectorals. The most popular exercises that are currently used to work the lower pectoral region are the dumbbell fly, decline press, and weighted dip. Although these exercises do develop the lower pectoral area, they are very basic and can oftentimes result in the area being overworked. The result of this overworking is the creation of more muscle than is needed thus giving the chest area an unwanted drooping effect.

Cross cable exercises are also effective in developing the pectoral muscles. Cross cable exercises can take on various forms using either high cables or low cables. Cable exercises in general typically involve a wire rope cable threaded through a series of pulleys to properly orient the cable with respect to the individual performing the exercise. One end of the cable is affixed to a weight for providing a desired resistance, and the other end of the cable has a grip attached thereto for the individual to grasp with his hands. The most common grip is a 'stirrup' grip wherein a tubular handle is grasped by the individual performing the exercise and the handle is attached to the cable by a Y-shaped feature extending from the ends of the tubular handle and converging at the end of the cable, thus defining a triangularly shaped void through which the individual can place his hands to facilitate gripping the handle.

I have discovered that the most effective means for developing the lower pectoral muscle is by using a low cable exercise. The low cable exercise is generally one wherein the cable is oriented to provide resistance when an individual's hand is raised from an initial low position with an upward movement toward the individual's upper body. The use of standard stirrup grips when performing this exercise generally results in the palm of exerciser's hand being substantially vertically oriented and parallel with the trunk of his body at the end of the exercise. However, the low cable exercise is most effective when the exerciser's hand remains substantially parallel to the floor and facing upward.

Thus what is desired is an exercise grip for use during low cable pectoral exercises and that promotes maintaining the exerciser's palm in an upwardly facing orientation and parallel to the floor and a method for using the grip.

SUMMARY OF THE INVENTION

The present invention is directed to an exercise grip and a method for performing pectoral development exercises utilizing the grip that satisfies the need to maintain the exerciser's palm in a supinated or upwardly facing orientation when exercising with a cable weight system or elastometric tension cord system. The exercise grip includes a body substantially formed to receive thereon the palmer side of a human hand. The body has an upturned flange formed at an outer edge of the body to bear against the ulnar border of a human hand. An elongate finger grip extends from and is oriented substantially perpendicular to the upturned flange and is formed to accommodate the curled fingers of a human hand therearound. A thumb recess is adjacent to the finger grip opposite from the upturned flange for allowing a human thumb to bear thereagainst. The finger grip and thumb recess may be provided with a form fitting impression material, such as memory foam or clay, that conforms to the individual user's hand and retains the user's finger grip impression. A hook is affixed to the body proximate to the thumb recess to facilitate attachment to the cable of the cable weight system.

Another aspect of the present invention is a method for performing a pectoral muscle developmental exercise utilizing a low cable weight apparatus or elastometric tension cord system. The method is performed by attaching the hook of an exercise grip to the cable of the cable weight apparatus or, alternatively, to the end of one or more elastometric tension cords that are anchored at the opposite end. The exercise grip includes an upturned flange for bearing against the ulnar border of the user's hand and wherein the hook is positioned oppositely from the upturned flange. The exercise grip is grasped with a first hand such that an ulnar border of the hand bears against the upturned flange of the grip and the thumb is positioned such that one of the thumb's metacarpalphalangeal and carpometacarpal joints is proximate to the hook. The first hand and exercise grip are rotated to a supinated position and the placed substantially at the mid-thigh area of the user's leg on the same side of the user's body. The first hand and exercise grip are translated, by utilizing only the upper arm while maintaining a slight bend in the elbow, from the user's mid-thigh area in an upwardly angular motion against the resistance of the cable weight and to the user's lower chest area on a side opposite from the first hand. The first hand is maintained in the supinated position throughout the translating step, and is then returned to the user's mid-thigh area. The supinated hand and grip can be repeatedly translated and returned to perform a plurality of repetitions.

The exercise method can be modified by holding the opposite forearm against the exerciser's chest in a pronated orientation and substantially parallel to the floor, and then translating the supinated hand and grip, utilizing only the upper arm while maintaining a slight bend in the elbow, from the mid-thigh area in an motion upwardly and angularly away from the user's body against the resistance of the cable weight and toward the second opposite side of the user's body to a height substantially horizontal to the height of the second opposite arm.

These and other features, aspects, and advantages of the invention will be further understood and appreciated by those skilled in the art by reference to the following written specification, claims and appended drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
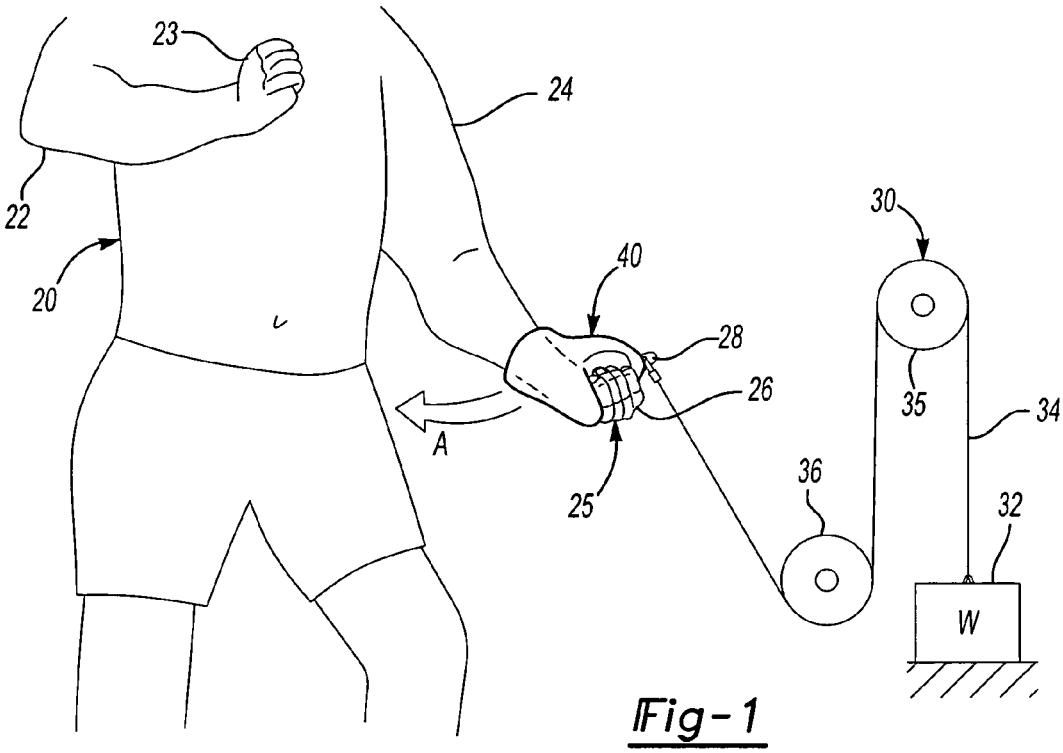
FIG. 1 is an elevation view of an individual starting a low cable pectoral exercise repetition utilizing an exercise grip embodying the present invention, wherein the exerciser's palm is maintained in an upwardly facing orientation and substantially parallel to the floor.
Figure 5:
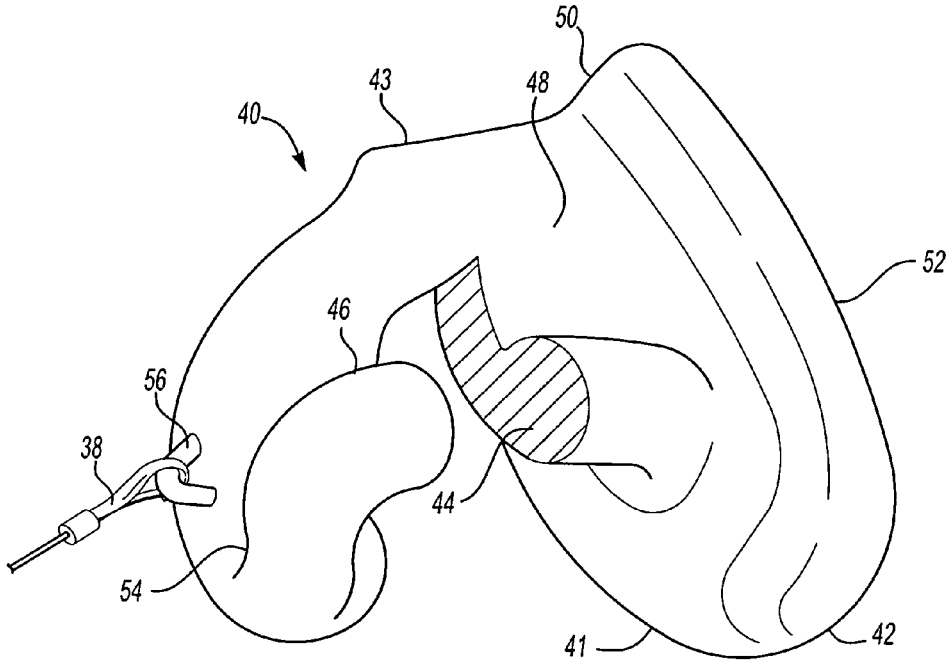
FIG. 5 is an inverted perspective view and partial section of the exercise grip of FIG. 4 illustrating its various features.

For purposes of description herein, the terms "upper", "lower", "left", "rear", "right", "front", "vertical", "horizontal", and derivatives thereof shall relate to the invention as oriented in FIGS. 1 and 5. However, one will understand that the invention may assume various alternative orientations and step sequences, except where expressly specified to the contrary. While the present invention has been shown and described in accordance with preferred and practical embodiments thereof, one will also recognize that departures from the instant disclosure are fully contemplated within the spirit and scope of the invention. Hence, specific dimensions and other physical characteristics relating to the embodiments disclosed herein are not to be considered as limiting, unless the claims expressly state otherwise.

Figure 2:
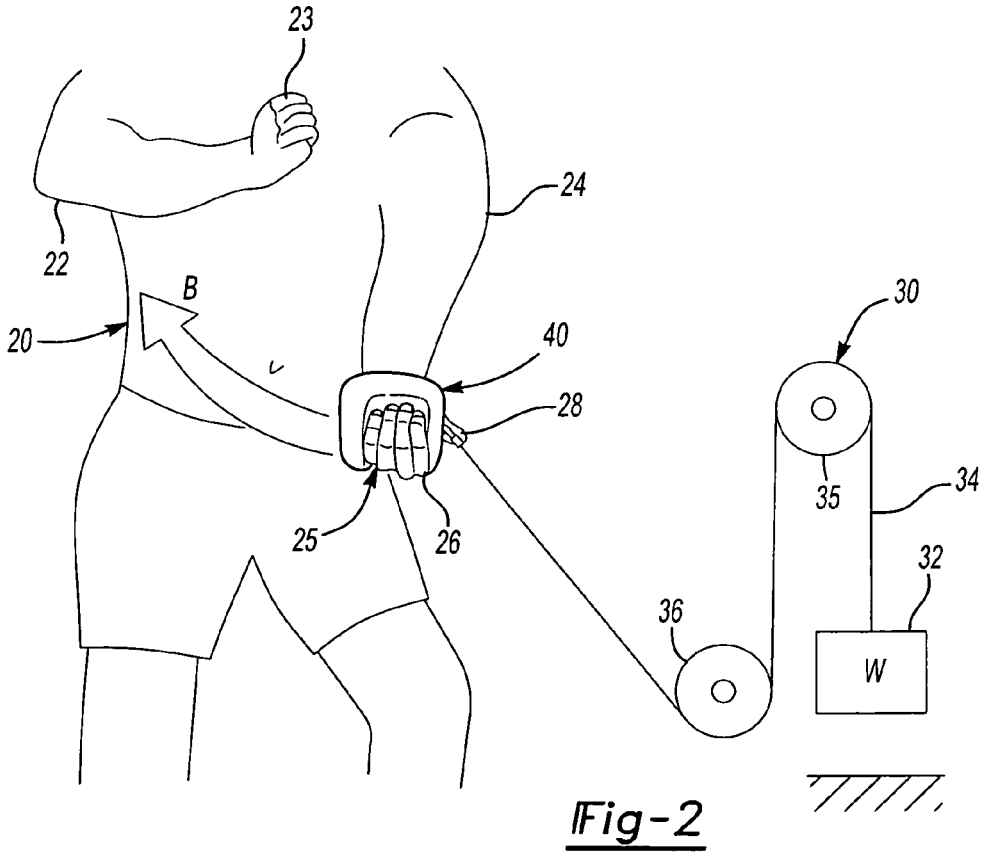
FIG. 2 is an elevation view of the individual at an intermediate stage of performing the low cable exercise repetition of FIG. 1.
Figure 3:
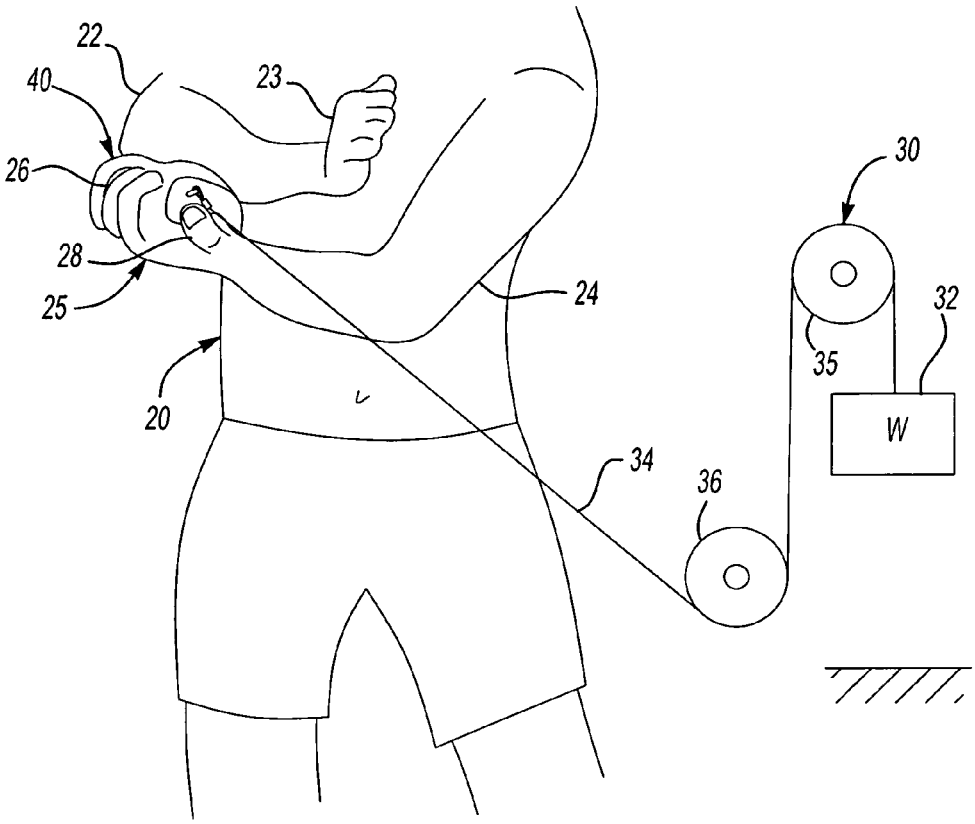
FIG. 3 is an elevation view of the individual at an end stage of performing the low cable exercise repetition of FIG. 1.

Turning to the drawings, FIG. 5 shows an exercise grip 40 which is one of the preferred embodiments of the present invention and illustrates its various components. Exercise grip 40 is generally compatible for use with a cable weight exercise apparatus 30 configured for low cable exercises as illustrated in FIGS. 1-3. While apparatus 30 can be configured in any one of a plurality of embodiments of well known exercise equipment, the basic configuration comprises a weight 32 that can be adjusted to either increase or decrease the resistive force against which the user acts. Weight 32 is attached to and responsive to the movement of cable 34 through a series of pulleys 35, 36. At least one of the pulleys, such as pulley 36, is positioned near the floor such that the user must exert an upward force at clasp 38 (FIGS. 4-5) affixed to an end of cable 34 to displace weight 32 from its resting place thereby generating the desired resistive force for performing the exercise. The positioning of pulley 36 near the floor requiring an upward force at clasp 38 to displace weight 32 is generally referred to as a low cable exercise. Clasp 38 facilitates the easy attachment and removal of various grips and mechanisms to cable 34 for a variety of exercises. Alternatively, the exercise grip 40 of the present invention may be used with an elastometric tension cord system.

Figure 4:
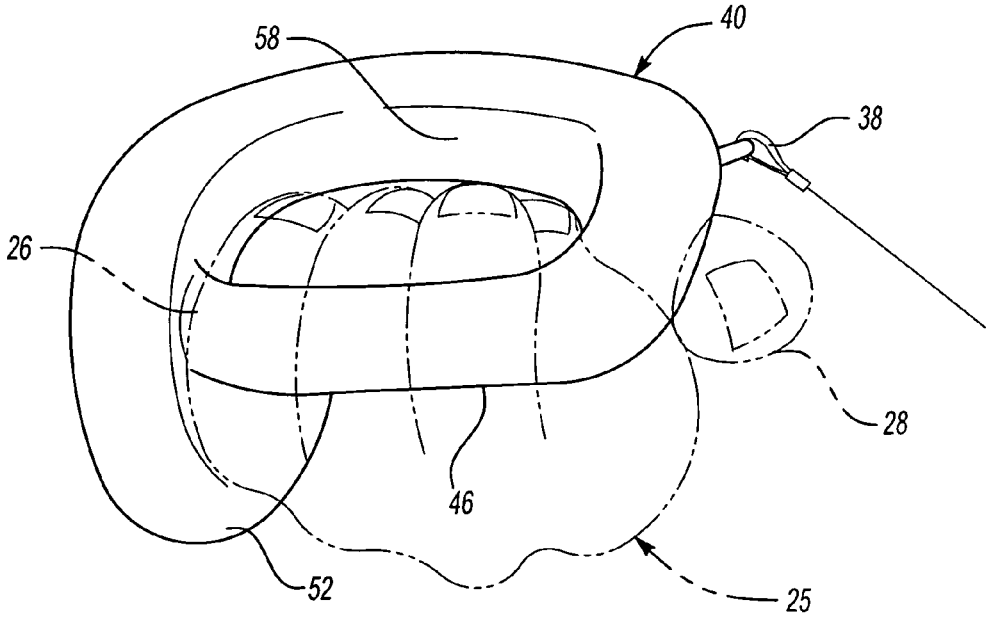
FIG. 4 is an elevation view of the exercise grip attached to a cable with an exerciser's hand shown in phantom in the desired palm up orientation.

Turning to FIGS. 4-5, an exercise grip 40 for performing a lower pectoral muscle developmental exercise is generally formed of a one piece body 41. Body 41, while shown in a molded resinous configuration 44, can also be formed of cast metal, from a sheet of formable metal, or any other manufacturing method sufficient to provide the various features described herebelow.

Body 41 of exercise grip 40 as most clearly illustrated in FIG. 5, is here configured for use with a user's left hand 25 (also referred to herein as the user's first hand). Those practiced in the art will recognize that an exercise grip for use by a right hand can be configured as a mirror image of exercise grip 40. Body 41 has a distal end 42 that to the placement of fingers 26 of left hand 25 and a proximate end 43 which extends away from distal end 42 toward the user's wrist and forearm. An outer edge of body 41 is formed as an upturned flange 52 and generally terminates at flange end 50. Flange end 50 typically coincides with proximate end 43 although other configurations are contemplated wherein upturned flange extends beyond proximate end 43 or alternatively terminates intermediately between distal end 42 and proximate end 43. As a minimum, flange end 50 of upturned flange 52 terminates at the wrist of the user such that upturned flange 52 bears against the outside edge of the hand defined by the fifth finger and fifth metacarpal. This outside edge is also known as the ulnar border of the hand. Most preferably, flange end 50 extends proximally beyond the wrist such that upturned flange 52 bears against the ulnar border of the user's hand, the medial side of the wrist and at least partially along the ulnar border of the forearm. The proximal extension of flange end 50 is such that upturned flange 52 bearing against the ulnar border of the user's forearm further stabilizes hand 25 with respect to the forearm. This extension thus helps prevent unwanted radial deviation or lateral rotation of the wrist as a result of forces imparted to the ulnar border of the hand by upturned flange 52.

An elongate finger grip 46 extends from upturned flange 52 in a substantially perpendicular manner. Finger grip 46 can be cylindrical in cross-section or otherwise formed to comfortably allow fingers 26 of hand 25 to curl therearound and comfortably grasp finger grip 46. A thumb recess 54 is positioned at an end of finger grip 46 opposite from upturned flange 52 and is shaped to allow thumb 28 to be placed thereagainst to aid in the grasping of exercise grip 40. The finger grip and thumb recess may be provided with a form fitting impression material, such as memory foam or clay, that conforms to the individual user's hand and retains the user's finger grip impression.

A hook 56 is embedded in body 41 to facilitate the connecting of clasp 28 to exercise grip 40. Hook 56 is positioned between proximal end 43 and distal end 42 to substantially align with the area of the metacarpalphalangeal joint (second joint from the tip of thumb 28) or the carpometacarpal joint (thumb joint most proximate to the wrist). Most preferably, hook 56 is substantially aligned with the metacarpalphalangeal joint and close to the palm side of the user's hand. This placement of hook 56 minimizes the torque applied to user's hand 25 and facilitates the proper orientation of hand 25 during performance of the pectoral development exercise as discussed below.

A planar palm rest 48 can extend inwardly from upturned flange 52 and proximally from finger grip 46 to provide an area to abut the palm of the user's hand 25. In like manner, an opposite face therefrom defines a finger rest 58 to define an area for accommodating the tips of fingers 26 when grasping finger grip 46.

Figure 6:
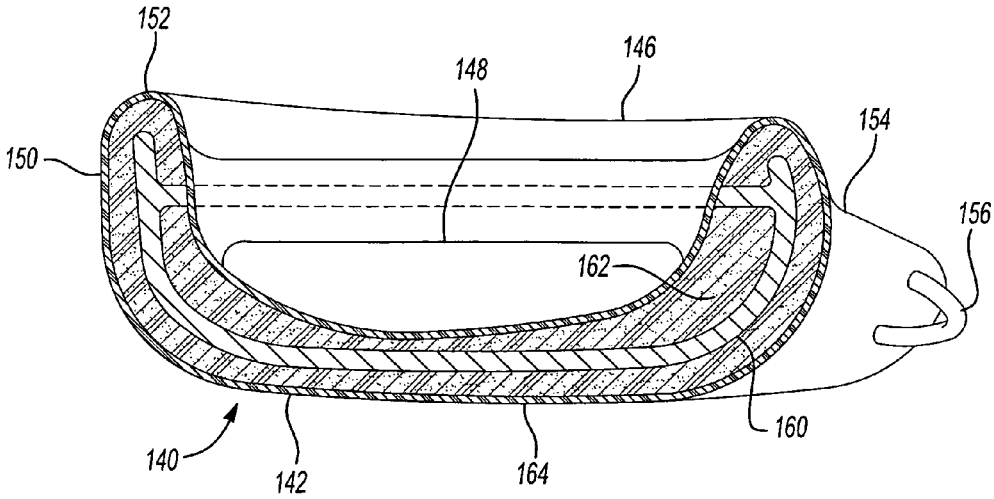
FIG. 6 is a cross-section of a second embodiment of the exercise grip illustrating an alternate construction.

FIG. 6 illustrates an alternate exercise grip embodiment 140 wherein like features similar to grip 40 are identified with the same numerical index preceded by the numeral "1". The alternate grip embodiment 140 is exemplified by an alternate construction wherein grip 140 has a central rigid core 160 to which hook 156 is anchored. Rigid core 160 is covered with a resilient layer such as resilient foam 162. Resilient foam 162 is shaped to provide the desired contours for comfortably accommodating the contours of user's hand 25. Resilient foam 162, in turn, is covered with a flexible and moisture impervient layer to prevent resilient foam 162 from absorbing various bodily fluids such as perspiration.

Turning again to FIGS. 1-3, the proper method for using exercise grip 40 is illustrated. The following description is directed to an exercise using the left hand 25. Those practiced in the art will readily recognize that the method described herein is also applicable to the right hand using an exercise grip formed as a mirror image of exercise grip 40. Exercise grip 40 is attached to cable 34 of weight apparatus 30 by engaging clasp 38 (FIG. 5) on hook 56. The user grasps exercise grip 40 by placing the ulnar border of his left hand to bear against upturned flange 52, curling fingers 26 about finger grip 46, and placing thumb 28 against thumb rest 54. The user's hand should now be placed such that hook 56 is generally aligned with the area of metacarpalphalangeal and carpometacarpal joints of thumb 28 and most preferably aligned with the metacarpalphalangeal joint (second joint from the tip of thumb 28).

Once exercise grip 40 is properly grasped in hand 25 the user rotates hand 25 to a supinated (palm up) position and then placing the supinated left hand 25 and exercise grip 40 substantially at the mid-thigh area of the left leg. The left elbow is bent slightly and maintained in that fixed bend while translating hand 25 from the mid-thigh area of the left leg in an upwardly angular motion against the resistance of weight 32 toward the user's right chest area. In a most preferable method, the user's right arm 22 is placed such that its forearm is placed against the user's right chest in a horizontal pronated position (palm down). The user's right hand is extended at the wrist so that the right palm is generally vertical and aligned with the center or sternum of the user's chest. The fingers of the hand can be curled toward the palm. In the most preferable method, the translation of the left hand terminates at a position extended from and in front of the user's right chest and to a height substantially horizontal to the height of the forearm of right arm 23. The supinated orientation of left hand 25 is maintained throughout the translational movement. Supinated left hand 25 is returned to its starting position at mid-thigh of the left leg in a similar reverse motion. The translation and returning motions can be repeated in alternating fashion for a desired plurality of repetitions.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

I claim:

1. An exercise grip attachable to a weight cable for performing a low cable pectoral muscle development exercise, said exercise grip comprising:

a main body including an elongate flange and a generally cylindrical portion defining a finger grip for receiving the curled fingers of a user's hand;

said elongate flange having a front end, an opposite rear end, a top, a bottom, an inner face and an outer face, and said inner face structured and disposed to bear against the ulnar border of a user's hand from the fingers to the wrist of the user when the user's fingers are curled about said finger grip;

said finger grip having a first end extending from said inner face of said elongate flange and an opposite second end positioned away from said inner face, and said finger grip extending generally perpendicularly and horizontally from said inner face of said elongate flange at a location that is closer to said front end of said elongate flange than said rear end of said elongate flange;

said inner face of said elongate flange including a first portion extending forwardly from said first end of said finger grip to said front end of said elongate flange, and said inner face of said elongate flange including a second portion extending rearwardly from said first end of said finger grip to said rear end of said elongate flange, and the distance between said first end of said finger grip and said rear end of said elongate flange being greater than a distance from said first end of said finger grip to said front end of said elongate flange; and a hook on said main body for attaching the weight cable thereto.

2. The exercise grip according to claim 1 wherein said main body is a unitary integrally formed structure.

3. The exercise grip according to claim 1 wherein said finger grip includes:

a formed rigid core; and a resilient layer overlaying said rigid core.

* * * * *